US005539417A

United States Patent [19]

Terry et al.

[11] Patent Number: 5,539,417

[45] Date of Patent: Jul. 23, 1996

[54] ANTENNA CLIP ASSEMBLY AND ANTENNA CONTROL CIRCUIT FOR CELLULAR PHONE

[75] Inventors: John D. Terry, Salem; Brien J. Denheyer, Portland, both of Oreg.

[73] Assignee: Kelly Communications Group, Inc., Beaverton, Oreg.

[21] Appl. No.: 340,825

[22] Filed: Nov. 16, 1994

[51] Int. Cl.[6] ..... H01Q 1/24

[52] U.S. Cl. ..... 343/702; 174/35 R; 361/814

[58] Field of Search ..... 343/702; 174/35 R, 174/35 GC, 51; 361/814

[56] References Cited

U.S. PATENT DOCUMENTS

| | | | |
|---|---|---|---|
| 4,823,235 | 4/1989 | Suzuki et al. | 174/51 X |
| 4,872,091 | 10/1989 | Maniwa et al. | 174/51 X |
| 5,124,889 | 6/1992 | Houbert et al. | 174/35 R X |
| 5,211,581 | 5/1993 | Schwartz | 439/581 |
| 5,313,016 | 5/1994 | Brusati et al. | 174/35 GC |
| 5,333,100 | 7/1994 | Anhalt et al. | 174/35 R |
| 5,343,361 | 8/1994 | Rudy et al. | 174/35 R |

*Primary Examiner*—Donald T. Hajec
*Assistant Examiner*—Tho Phan
*Attorney, Agent, or Firm*—Marger, Johnson, McCollom & Stolowitz

[57] ABSTRACT

An antenna clip includes a U-shaped front end that slides into a slot on an edge of a printed circuit board (PCB). The PCB holds the clip rigidly in both a lateral direction and in a front to back parallel orientation with the PCB providing a reliable electrical contact between the antenna and the phone electrical circuitry. An antenna switching circuit switches between an internally connected antenna and an external system detachably coupled to an external connector. The antenna circuit has a wire length of $\lambda/4$ between the phone circuit and the antenna and a wire length of $N\lambda/2$ between the phone circuitry and the external system. The antenna then appears as an open circuit when coupled to ground through a diode. Alternatively, the external connector appears as an open circuit when disconnected from the external system.

11 Claims, 3 Drawing Sheets

ANTENNA CLIP ASSEMBLY AND ANTENNA CONTROL CIRCUIT FOR CELLULAR PHONE

BACKGROUND OF THE INVENTION

This invention relates generally to cellular phones and more particularly to various features of a cellular radio telephone antenna system.

A cellular telephone antenna must be coupled to electrical components on the phone's printed circuit board (PCB). During assembly and repair, the PCB might need to be detached from the rest of the cellular telephone, including the antenna. Thus, the physical coupling between the antenna and PCB must be detachable while at the same time providing a secure electrical connection. Present antenna connectors are bulky and difficult to assemble.

Cellular phones typically include circuitry that allow data transmission and reception of radio frequency signals from either an internally connected antenna or from an external communication source. The external source is either a relay system, such as an external antenna, that simply forwards the cellular radio signals to and from a cellular base station.

The internal conductors that connect the external source to the phone circuitry are generally routed inside the phone casing along the entire length of the phone. Long conductors are used so that the conductor length is equal to the wave length ($\lambda$) of the transmitted radio frequency signals. Thus, when the external source is disconnected, the conductor appears as an open circuit. However, long conductors are expensive and consume the limited space in the cellular phone case.

Accordingly, a need remains for an inexpensive and easy to assemble antenna system that uses minimal space in a portable cellular telephone handset.

SUMMARY OF THE INVENTION

An antenna clip for a mobile telephone is used in conjunction with a printed circuit board (PCB) to provide a secure electrical connection between the phone circuitry and the phone antenna. The antenna clip includes a U-shaped front end that slides into a slot on an edge of the PCB. The slot width is slightly greater than the thickness of the clip. When the clip is inserted into the slot, the clip is held rigidly in both a lateral direction and in a front to back parallel orientation with the PCB.

The slot is positioned next to a conductive trace that is coupled to internal phone circuitry. When the clip is inserted into the slot, the clip compresses against opposite sides of the PCB while at the same time making electrical contact with the trace. The clip includes a center section that operates as a spring contact while extending above the PCB. The center section is compressed against an antenna insert after the PCB is inserted into the phone casing.

According to another aspect of the invention, an antenna switching circuit provides switching between an internally connected antenna and various external systems. The antenna switching circuit uses a novel combination of wire lengths that allow the antenna to appear as an open circuit while being temporarily coupled to ground. In this combination, an external connector appears as a open circuit when disconnected from external communication systems.

A diode is used to disable the antenna from the phone circuitry and is turned on and off by either an external secondary power supply or by the phone's internal battery supply. When turned on, the diode grounds the antenna, disabling it from the telephone circuitry. The simple diode circuitry, along with the unique combination of wire lengths, provide a simple and reliable antenna control circuit.

The foregoing and other objects, features and advantages of the invention will become more readily apparent from the following detailed description of a preferred embodiment of the invention which proceeds with reference to the accompanying drawings.

DETAILED DESCRIPTION

Figure 1:
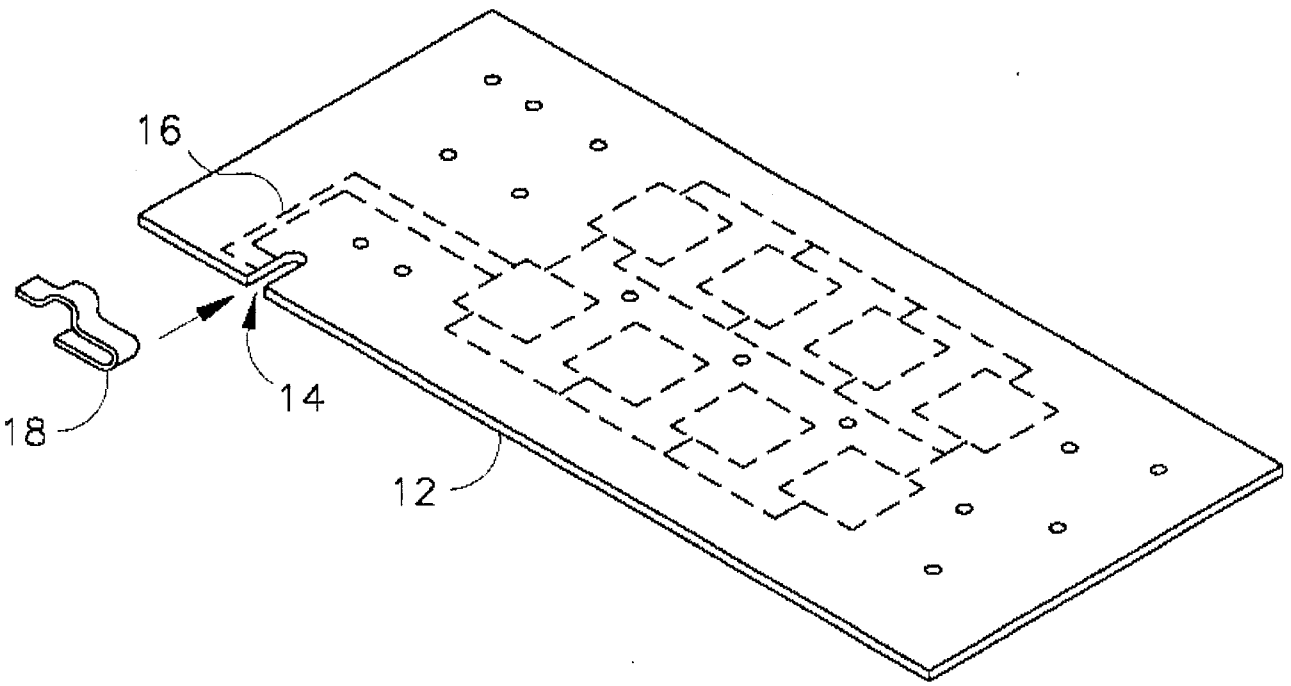
FIG. 1 is a perspective view of a printed circuit board and an antenna slip according to the invention.

FIG. 1 is a perspective view of a printed circuit board (PCB) 12 that contains the various electrical components 13 of a cellular telephone. A conductor 16 is commonly referred to as a trace. A first end of trace 16 is positioned above a slot 14 formed in an aege of PCB 12 and a second end is connected to the phone circuitry 13. The slot 14 is sized to slidingly receive an antenna clip 18 made from a conductive spring material, preferably copper.

Figure 2:
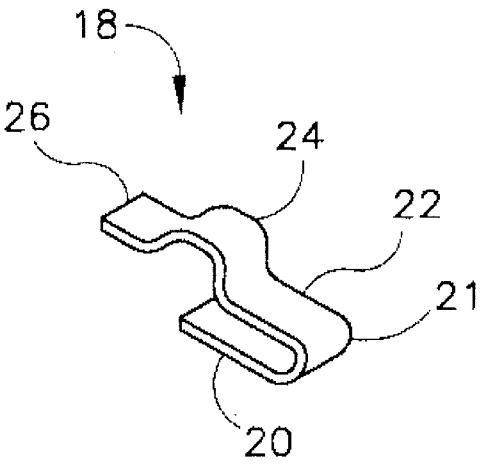
FIG. 2 is an enlarged perspective view of the antenna clip shown in FIG. 1.

FIG. 2 is an enlarged side perspective view of the antenna clip 18. The antenna clip 18 has a U-shaped front nose section 21 having a bottom member 20 that presses against a back side of circuit board 12 and a parallel top member 22 that presses against a front face of PCB 12 (FIG. 1). A hump-shaped center contact section 24 of clip 18 extends contiguously from the top member 22 of front nose section 21 beyond a distal end of bottom member 20. A rear section 26 is joined distally to the center contact section 24 and is aligned in substantially the same horizontal plane with top member 22. The center contact section 24 protrudes above both the top member 22 and rear section 26.

Figure 3:
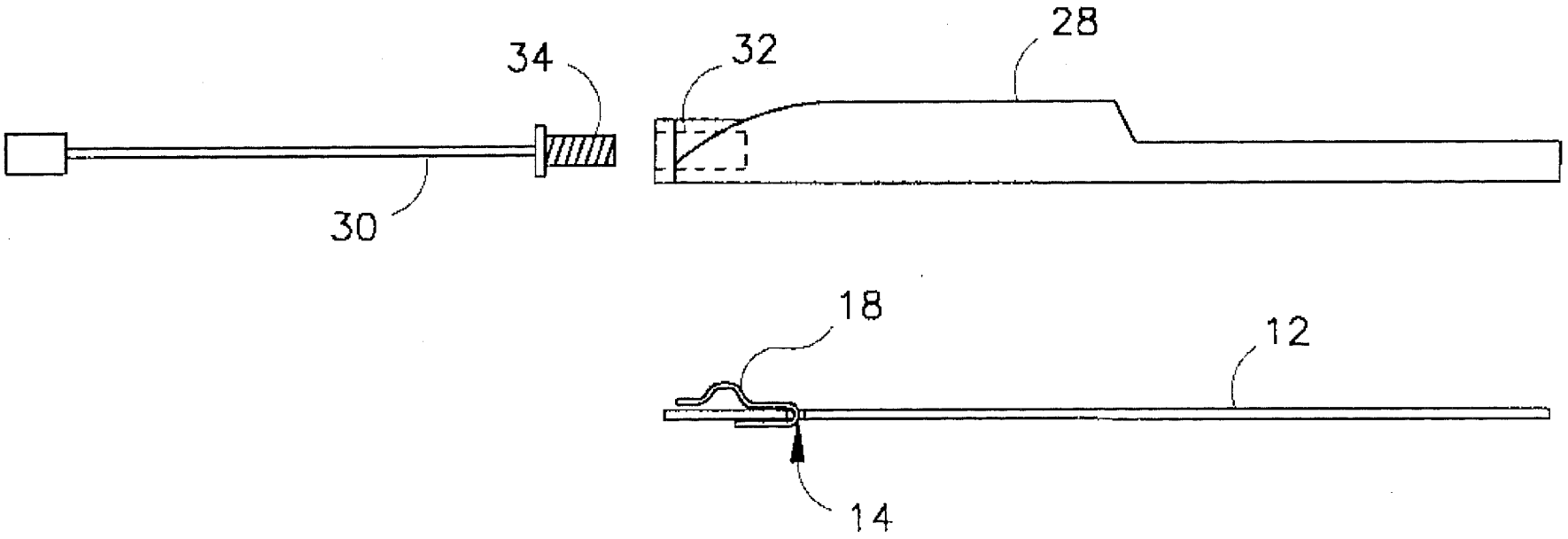
FIG. 3 is a side view of the PCB and antenna clip shown in FIGS. 1 and 2 being inserted into a phone casing.

FIG. 3 is a side view of the PCB 12 positioned below and insertable up into a bottom end 29 of a molded plastic phone casing 28. The antenna clip 18 is shown fully inserted inside slot 14 (FIG. 1) with top member 22 contacting the first end of trace 16. An antenna 30 includes a connector 34 with threads that engage with threads inside a brass insert 32. The insert 32 is encased inside a front end of a portable telephone casing 28.

Referring to FIGS. 1–3, the antenna clip 18 is slid sideways into slot 14. The slot 14 has a width 19 slightly greater than the thickness 23 of the antenna clip 18. Thus, when inserted into PCB 12, the clip 18 is kept from moving in a lateral direction 15.

The distance between upper member 22 and lower member 20 is slightly less than the thickness of PCB 12. Therefore, while being slid into slot 14, the top and bottom members are pushed slightly away from each other, holding the front and back sides of PCB 12 in compression. The clip 18 is then soldered to trace 16 without an assembler having to physically hold the clip 18 to the PCB 12.

The depth 15 of slot 14 is substantially equal to the width 17 of clip 18. Thus, when fully inserted into slot 14, the clip 18 is automatically aligned with the first end of trace 16.

As seen in FIG. 3, the center section 24 of clip 18 operates as a leaf spring protruding above the top face of PCB 12. As the PCB 12 is inserted upward into the bottom end 29 of phone casing 28, the center section 24 of clip 18 makes contact with insert 32. The spring characteristics of clip 18 allow the center section to compress slightly downward making a secure electrical contact with insert 32.

The threaded connector 34 of antenna 30 is screwed into insert 32, making electrical contact via clip 18 with trace 16. If PCB 12 is ever removed, the compressed condition between clip 18 and insert 32 is removed, allowing the center section 24 to rebound slightly upward. The clip 18 remains in place, ready for reinsertion of the PCB into casing 28. Thus, the antenna apparatus described above is simple and easy to assemble and disassemble while providing a secure electrical connection between the antenna 30 and the phone circuitry connected to trace 16 when assembled.

ANTENNA SWITCH

Figure 4:
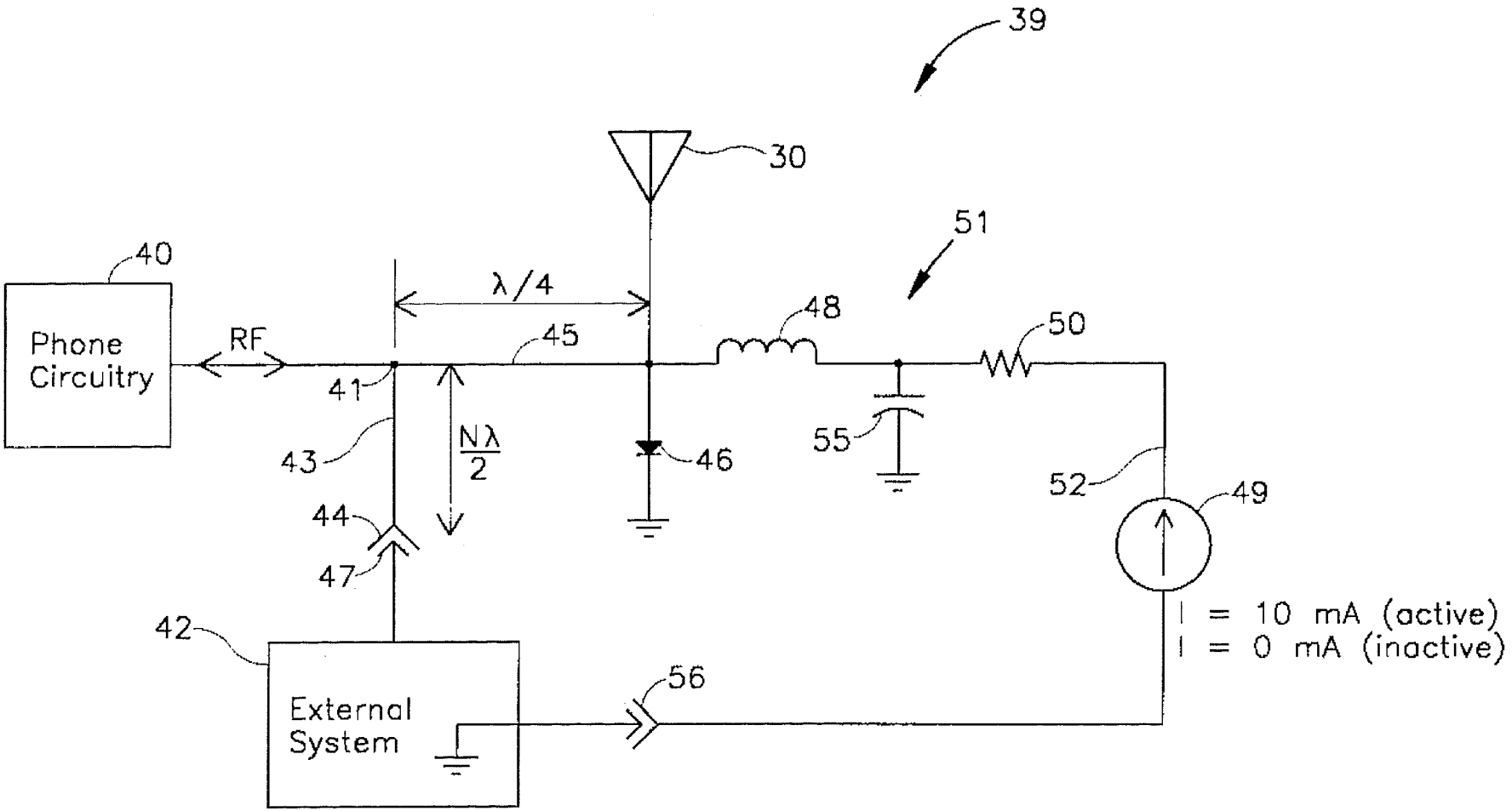
FIG. 4 is a circuit diagram of an antenna switching circuit according to another aspect of the invention.

FIG. 4 is a circuit diagram of an antenna switching circuit 39 according to another aspect of the invention. Radio frequency (RF) signals are transmitted and received from phone circuitry 40 as described in copending application Ser. No. 08/341,400, filed Nov. 17, 1994, entitled "Dual Mode Analog and Digital Cellular Phone assigned to the same assignee.

The phone circuitry 40 can include a duplexer (not shown) coupled to the antenna switching circuit 39 at node 41. The node 41 is coupled to both an antenna 30 and to a detachable external system 42 via an external connector 44. The antenna 30 is coupled through a diode 46 to ground. A diode bias circuit 51 comprises an RF block inductor 48, a decoupling capacitor 55 and a bias resistor 50. The bias circuit is coupled between a current source 53 and the antenna 30 through a switch control path 52.

The length of a conductor 45 from node 41 to the antenna 30 is selected to be approximately one quarter of the RF signal wave length ($\lambda/4$) output from phone circuitry 40. The length of a conductor 43 from the node 41 to external connector 44 is a multiple of wavelength $\lambda$ divided by two ($N\lambda/2$), where N is any integer.

When no external system is coupled to external connector 44, diode 46 is shut off, enabling antenna 30 to receive and transmit signals from phone circuitry 40. Since conductor 43 has a length of $N\lambda/2$, it appears as an open circuit at node 41. Thus, conductor 43 will minimally effect the RF signal from phone circuitry 40 to antenna 30.

The external system 42 can contain an auxiliary DC power supply or can be coupled to an external power supply. When inserted into external connector 56, current supply 49 is automatically activated (e.g., 10 mA) biasing diode 46, in turn, shorting antenna 30 to ground. When external system 42 is disconnected from external connectors 44 and 56, current source 49 is deactivated (e.g., 0 mA) re-enabling antenna 30.

While an RF diode switch 46 is used to enable and disable antenna 30, it is understood that alternative switching circuits can be used to selectively short antenna 30 to ground.

Alternatively, when connector 44 is connected to an external system that does not contain a power supply, the phone's internal battery can be used via a jumper to bias RF diode switch 46. For example, a car antenna can be coupled to the external connector 44 to improve reception while the phone is operating in a car. If the car antenna does not have a separate power supply or cannot be attached to the car battery, the cellular phone's internal battery is used to activate diode 46.

Typically, a 50Ω impedance exists at input node 41 and the external system comprises a 50Ω impedance. Thus, when the external system 42 is coupled to external connector 44, a matched system is created, minimizing reflection and other transmission line effects created by conductor 43.

Due to the short at the far end of conductor 45, $\lambda/4$ is seen as an open circuit at input node 41. Thus, the antenna switching circuit 39 effectively removes antenna 30 and conductor 45 from the system while RF signals are directed to external system 42.

It is important to note that the antenna circuitry shown in FIG. 4 is only activated when the external system 42 is connected to external terminal 44. Therefore, the current used for biasing the diode 46 (e.g., 10 milliamps) is typically supplied by the external system 42. However, when the external system is disconnected, the current is zero. Thus, energy from the internal phone battery is not generally used when operating the antenna switching circuit 39.

The system is also designed for high reliability. For example, it is possible that diode 46 could fail preventing the antenna from grounding out when an external source is coupled to external connector 44. In this situation, there will be a 50Ω impedance at external connector 44 and 50Ω impedance from internal antenna 30. The resultant 25Ω parallel impedance remains within the typical operating capacity of a power amplifier (not show) inside phone circuitry 40. Thus, the phone circuitry 40 will operate and not be damaged even if the antenna control system 39 malfunctions.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. An antenna assembly for a portable phone, comprising:

a printed circuit board containing circuitry for the portable phone, the printed circuit board including a slot;

a conductive trace having a first end connected to the phone circuitry and a second end aligned alongside the slot;

an antenna clip slidingly insertable into said slot thereby aligning the clip with the trace to make electrical contact therewith, the clip further including an antenna contact area; and an antenna for transmitting and receiving radio signals, the antenna pressing against the antenna contact area forming an electrical contact from said antenna through the antenna clip to the conductive trace.

2. An assembly according to claim 1 including a phone casing having a bottom side for receiving the printed circuit board and further including an insert for receiving the antenna, the printed circuit board when inserted into the bottom side of the phone casing forming a compression contact between the clip and insert, the clip aligned sideways along an elongated longitudinal axis in the notch that extends perpendicularly through a side edge of the printed circuit board.

3. An assembly according to claim 1 wherein the clip comprises a metal strip elongated about a central axis, a front end of the metal strip formed into a front nose section having a top and bottom member forming a U-shaped profile, the top member and bottom member compressing against opposite sides of the printed circuit board, the metal strip further including a center section formed into an upwardly protruding hump.

4. An antenna assembly for a portable phone, comprising:

a printed circuit board containing circuitry for the portable phone, the printed circuit board including a slot;

a conductive trace having a first end connected to the phone circuitry and a second end aligned alongside the slot; and an antenna clip slidingly insertable into said slot thereby aligning the clip with the trace to make electrical contact therewith, the clip including the following;

a front nose section having a top and bottom member forming a U-shaped profile, the top member and bottom member compressing against opposite sides of the printed circuit board:

an upwardly protruding center section joined to the front nose section; and a rear section joined to the center section, the rear section in horizontal alignment with the top member of the front nose section.

5. An assembly according to claim 1 wherein the slot comprises a narrow slit that extends perpendicularly through a side edge of the printed circuit board, the slit having a width slightly greater than a thickness of the clip and the clip having a longitudinal axis perpendicular to the longitudinal axis of the slit.

6. An assembly according to claim 5 wherein the length of the slot along the longitudinal axis is substantially equal to a given width of the clip.

7. An assembly according to claim 5 wherein the central axis of the clip when inserted in said slot is aligned substantially parallel with a longitudinal axis of the antenna.

8. A method for attaching an antenna to circuitry on a printed circuit board in a telephone, comprising:

providing an antenna clip;

forming a slot in the printed circuit board;

routing the trace between the circuitry and the slot;

slidingly inserting the clip into the slot while at the same time making electrical contact with the trace; and compressing an antenna against the antenna clip forming a pressure induced electrical contact between the antenna and the trace.

9. A method according to claim 8 including sizing the slot to have a width substantially equal to a given thickness of the antenna clip.

10. A method according to claim 8 including providing a phone casing having a bottom end for receiving the printed circuit board and an insert for receiving the antenna and including the step of inserting the printed circuit board into the bottom end of the casing so that the insert presses down onto the clip.

11. A method according to claim 8 wherein the clip holds opposite sides of the printed circuit board in compression while at the same time springingly extending above said circuit board.

* * * * *